US006842914B1

(12) United States Patent
Broadway

(10) Patent No.: US 6,842,914 B1
(45) Date of Patent: Jan. 18, 2005

(54) PROTECTIVE IMPACT-ABSORBING HELMET

(76) Inventor: Fred Broadway, 6935 Fawn Path, Shreveport, LA (US) 71119

( * ) Notice: Subject to any disclaimer, the term of this patent is extended or adjusted under 35 U.S.C. 154(b) by 0 days.

(21) Appl. No.: 10/436,420

(22) Filed: May 12, 2003

(51) Int. Cl.[7] ..... A63B 71/10
(52) U.S. Cl. ..... 2/425; 2/421
(58) Field of Search ..... 2/421, 425, 411, 2/412

(56) References Cited

U.S. PATENT DOCUMENTS

| | | | | | |
|---|---|---|---|---|---|
| 1,491,146 | A | * | 4/1924 | Larson | 2/106 |
| 2,546,842 | A | * | 3/1951 | Mahlon | 2/425 |
| 2,886,818 | A | * | 5/1959 | Roberts | 2/421 |
| 3,087,166 | A | * | 4/1963 | Howard | 2/420 |
| 5,075,903 | A | * | 12/1991 | Richoux | 2/411 |
| 6,425,141 | B1 | * | 7/2002 | Ewing et al. | 2/412 |
| 6,427,253 | B1 | * | 8/2002 | Penny | 2/412 |
| 6,691,324 | B1 | * | 2/2004 | Nakamura | 2/425 |

FOREIGN PATENT DOCUMENTS

| | | | | | |
|---|---|---|---|---|---|
| JP | 10085379 | A | * | 4/1998 | A63B/71/10 |
| JP | 10248986 | A | * | 9/1998 | A63B/17/10 |
| JP | 2001214323 | A | * | 8/2001 | A42B/3/06 |
| JP | 2002058773 | A | * | 2/2002 | A63B/71/10 |
| JP | 2002253725 | A | * | 9/2002 | A63B/71/10 |

* cited by examiner

*Primary Examiner*—Rodney M. Lindsey
(74) *Attorney, Agent, or Firm*—Michael I. Knoll

(57) ABSTRACT

The present invention 10 discloses a convex shaped helmet 20 for encompassing the back of the head 14 of a user 18 having adjustable retaining straps 22, 24 extending across the front and the top of the head 14. The helmet 20 is positioned engaging the back 12 of the head 14 with an adjustable strap extending across the forehead 22 along with an additional adjustable strap 24 extending medially from the first strap engaging the helmet at its distal end. The straps 22, 24 prevent shifting of the helmet 20 during use. The helmet 20 is comprised of an external shell manufactured from an impact resistant material and has an interior layer of a compressible material 30 to engage the wearer's head 14. Means for adjusting 28 the straps 22, 24 are also provided.

12 Claims, 8 Drawing Sheets

PROTECTIVE IMPACT-ABSORBING HELMET

BACKGROUND OF THE INVENTION

1. Field of the Invention

The present invention relates generally to helmets and, more specifically, to a convex shaped helmet for encompassing the back of the head having adjustable retaining straps extending across the front. The helmet is positioned engaging the back of the head with an adjustable strap extending across the forehead with an additional adjustable strap extending medially from the first strap engaging the helmet at its distal end. The straps prevent shifting of the helmet during use. The helmet is comprised of an external shell manufactured from an impact resistant material and has an interior layer of a compressible material to engage the wearer's head.

The purpose of the helmet is to protect the back of the wearer's head during use. Many head injuries in sports are caused by backward falls resulting in damage or injury to the posterior portion of the head such as the external occipital protuberance, occipital bone and parietal bone. The instant invention overcomes such injuries by providing a convex shaped helmet, comprised of a hard, polymeric material having elastomeric adjustable head bands for securing said helmet to a wearer's head. The interior concave portion of the helmet is covered with a soft cushion foam like padding for comfort and further protection.

The device of the present invention is ideal for action sports minded children or for active children is a playground. With the helmet of the present invention, head injury due to backward falls can be eliminated.

Some of the sports the present invention can be utilized for are wrestling, basketball, volleyball, tennis, soccer, skate boarding, and jump rope or just playing in a playground. Another use would be for physical education classes and physical therapy classes.

2. Description of the Prior Art

There are many protective helmet devices known in the art. However, although these protective helmet devices may be suitable for the purposes for which they were designed, they would not be suitable for the purposes of the present invention, as hereinafter described.

SUMMARY OF THE PRESENT INVENTION

The present invention discloses a convex shaped helmet for encompassing the back of the head of a user having adjustable retaining straps extending across the front and the top of the head. The helmet is positioned engaging the back of the head with an adjustable strap extending across the forehead along with an additional adjustable strap extending medially from the first strap engaging the helmet at its distal end. The straps prevent shifting of the helmet during use. The helmet is comprised of an external shell manufactured from an impact resistant material and has an interior layer of a compressible material to engage the wearer's head. Means for adjusting the straps are also provided.

A primary object of the present invention is to provide a helmet that can be used during sporting events and play to protect the back of the head from impact.

Another object of the present invention is to provide an impact absorbing helmet having a convex shape for engaging the back of the head.

Yet another object of the present invention is to provide an impact absorbing helmet having an exterior surface comprised of an impact absorbing material.

Still yet another object of the present invention is to provide an impact absorbing helmet that will dissipate a blow across the structure of the helmet and have an interior shock absorbing material to prevent transfer of the blow to the head.

Another object of the present invention is to provide an impact absorbing helmet having an exterior surface comprised of a polymeric material.

Yet another object of the present invention is to provide an impact absorbing helmet having an interior layer forming an integral part of said helmet.

Still yet another object of the present invention is to provide an impact absorbing helmet having an interior layer comprised of a foam-like material.

Another object of the present invention is to provide an impact absorbing helmet having an interior layer that will engage the users head preventing random movement during use.

Yet another object of the present invention is to provide an impact absorbing helmet having means for retaining the selective positioning of said helmet.

Still yet another object of the present invention is to provide an impact absorbing helmet having a strap for engaging the front of the head.

Another object of the present invention is to provide an impact absorbing helmet wherein said strap has means for adjusting the length of said strap.

Yet another object of the present invention is to provide an impact absorbing helmet having an additional strap extending medially from the first strap and terminally engaging the helmet.

Still yet another object of the present invention is to provide an impact absorbing helmet wherein said second strap is adjustable.

Another object of the present invention is to provide an impact absorbing helmet having an adjustable strap webbing preventing movement of the helmet after selective placement either horizontally or vertically.

Yet another object of the present invention is to provide an impact absorbing helmet that will resist damage or injury to the posterior portion of the head such as the external occipital protuberance, occipital bone and parietal bone.

Still yet another object of the present invention is to provide an impact absorbing helmet that can be used during sporting events such as, wrestling, basketball, volleyball, tennis, soccer, skate boarding, jump rope or just playing in a play ground that will not impede the performance of the user.

Additional objects of the present invention will appear as the description proceeds.

The present invention overcomes the shortcomings of the prior art by providing a convex shaped impact absorbing helmet for encompassing the back of the head having adjustable retaining straps extending across the front. The helmet is positioned engaging the back of the head with an adjustable strap extending across the forehead with an additional adjustable strap extending medially from the first strap engaging the helmet at its distal end. The straps prevent shifting of the helmet during use. The helmet is comprised of an external shell manufactured from an impact resistant material and has an interior layer of a compressible material to engage the wearer's head.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
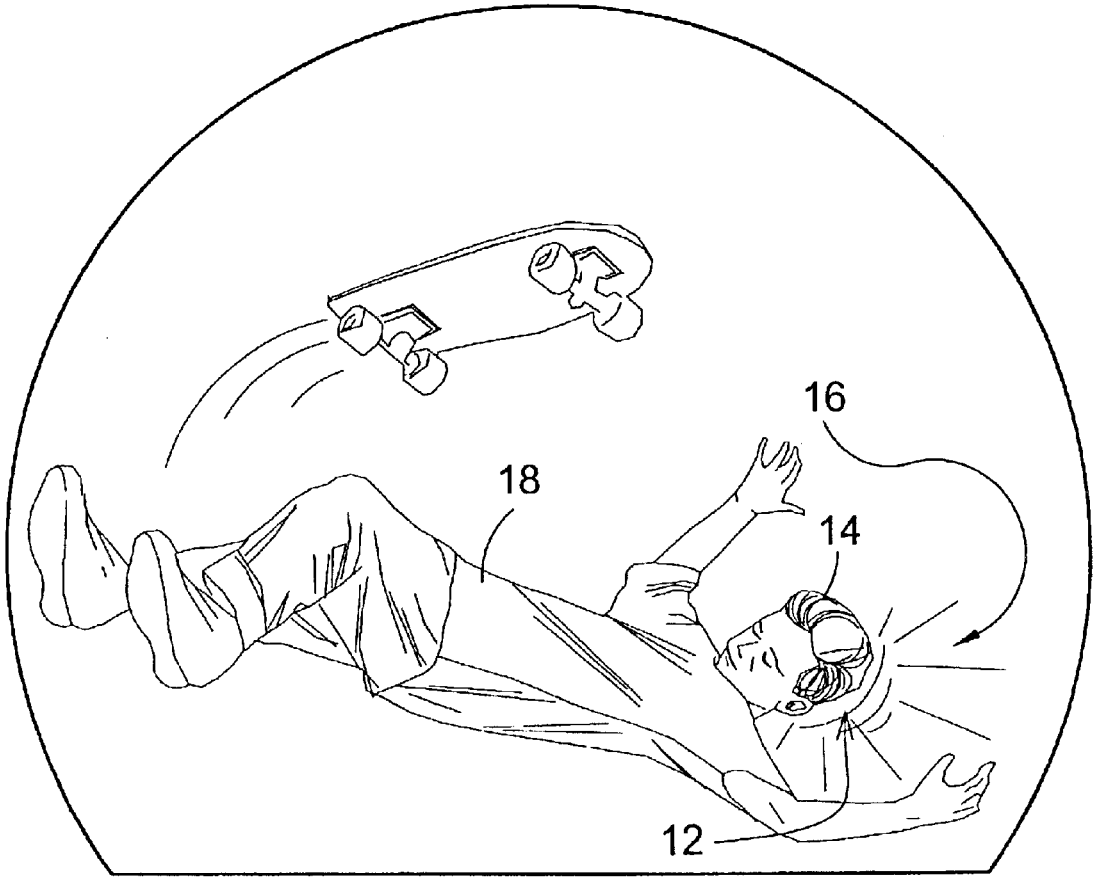
FIG. 1 is an illustrative view of prior art.

With regard to reference numerals used, the following numbering is used throughout the drawings.

10 present invention
12 posterior portion
14 head
16 impact area
18 user
20 helmet
22 forehead headband
24 top of head headband
26 logo
28 means for adjustment
30 liner

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the type of injury that can occur under prior art conditions. Many head injuries in sports are caused by backward falls resulting in damage or injury in the impact area 16 of the posterior portion 12 of the head 14 of a user 18 such as the external occipital protuberance, occipital bone and parietal bone during a backward fall. The present invention over comes such injuries by providing a convex shaped helmet, comprised of a hard, polymeric material having elastomeric adjustable head bands for securing the helmet to a wearer's 18 head 14. The interior concave portion of the helmet is covered with a soft cushion foam like padding for comfort and further protection. The device of the present invention is ideal for action sports minded children or for active children 18 in a playground. With the helmet of the present invention, head injury due to backward falls can be eliminated. Some of the sports the present invention can be utilized for are wrestling, basketball, volleyball, tennis, soccer, skate boarding, and jump rope or just playing in a playground. Another use would be for physical education classes and physical therapy classes.

Figure 2:
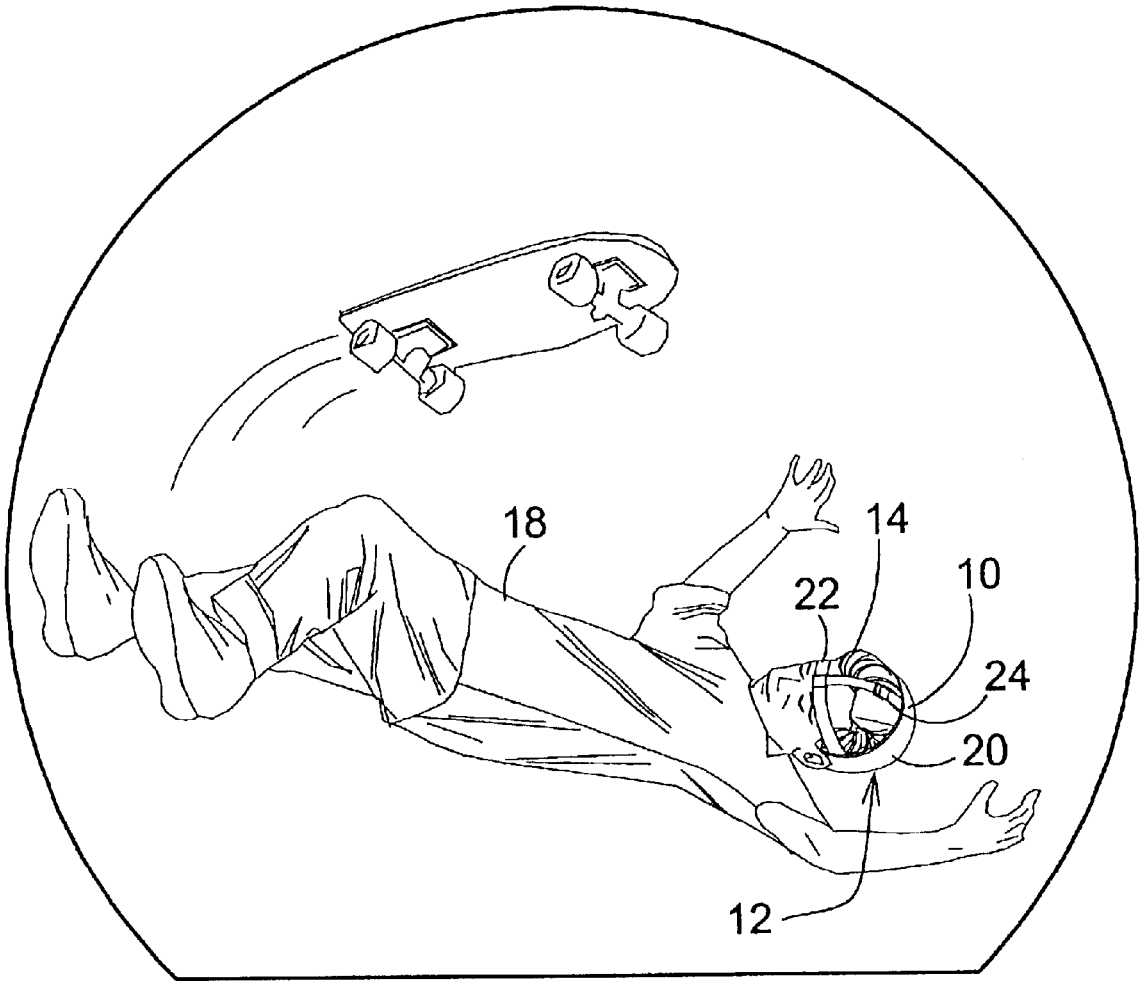
FIG. 2 is an illustrative view of the present invention in use.

Turning to FIG. 2, shown therein is an illustrative view of the present invention 10 in use. Shown is the present invention 10 comprised of a convex shaped helmet 20 formed of a hard polymeric material having elastomeric adjustable headbands 22, 24 providing means for securing the helmet 20 to the head 14 of the user 18. The interior surface of the helmet 20 has a layer of foam-like padding. The helmet 20 is worn on the posterior portion 12 of the head 14 to protect the external occipital protuberance, occipital bone and parietal bone from a severe blow as during a backward fall.

Figure 3:
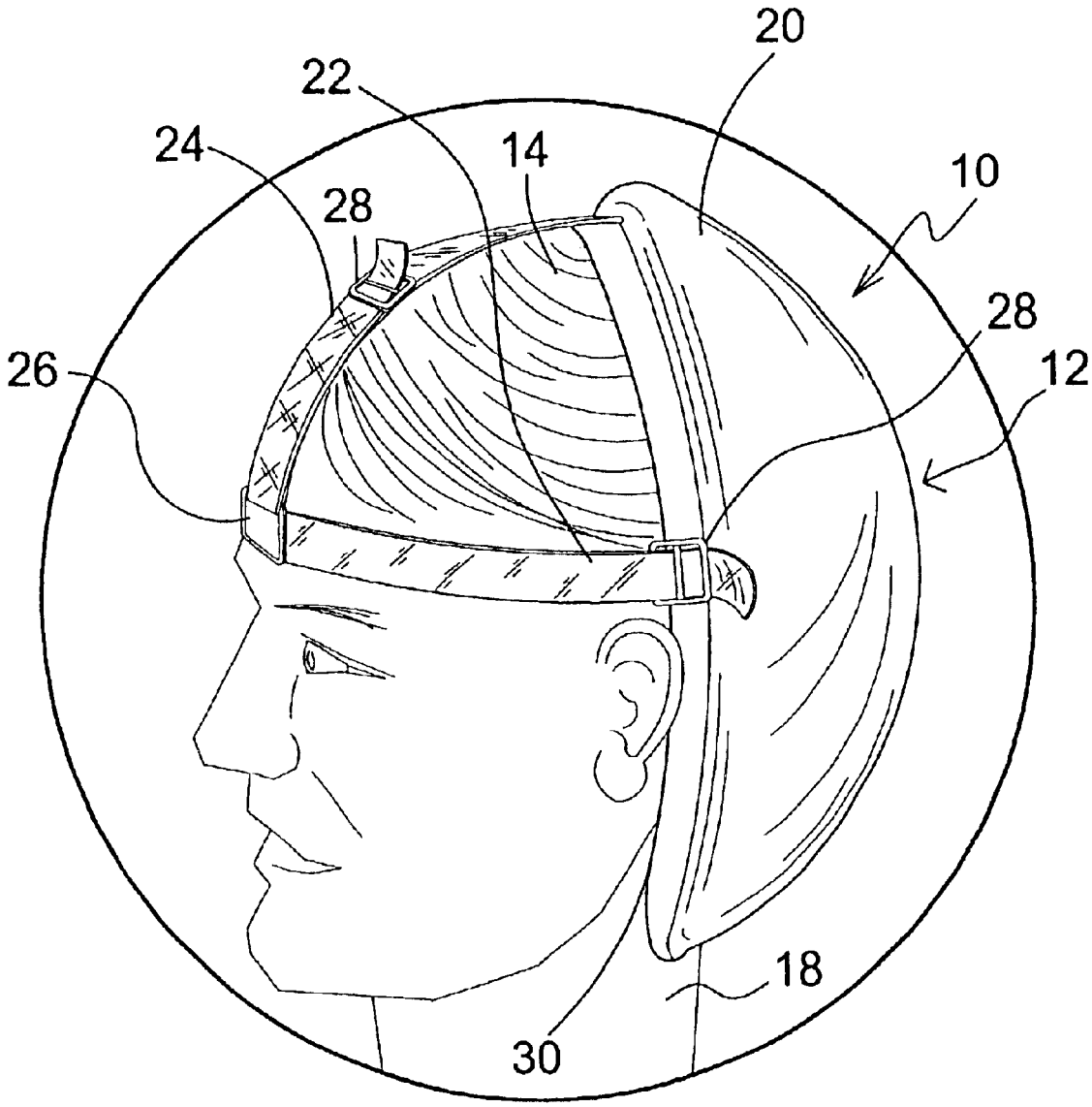
FIG. 3 is a side view of the present invention in use.

Turning to FIG. 3, shown therein is a side view of the present invention 10 in use. Shown is the present invention 10 in use whereby a user 18 places the convex helmet 20 over the back 12 of the head 14. The convex housing has means for retaining the protective helmet 20 over the back 12 by means of an adjustable strap that extend across the forehead 22 and a strap 24 extending from the top of the helmet to the forehead. Each strap 22, 24 has means 28 whereby a user 18 can selectively adjust the tensioning of the straps to suit the user. The strap 24 is movable along strap 22 at the point of attachment of strap 24 to strap 22. The exterior shell of the helmet 20 is comprised of an impact resistant material such as a hard polymeric material. A logo 26 may be conspicuously placed on the present invention 10.

Figure 4:
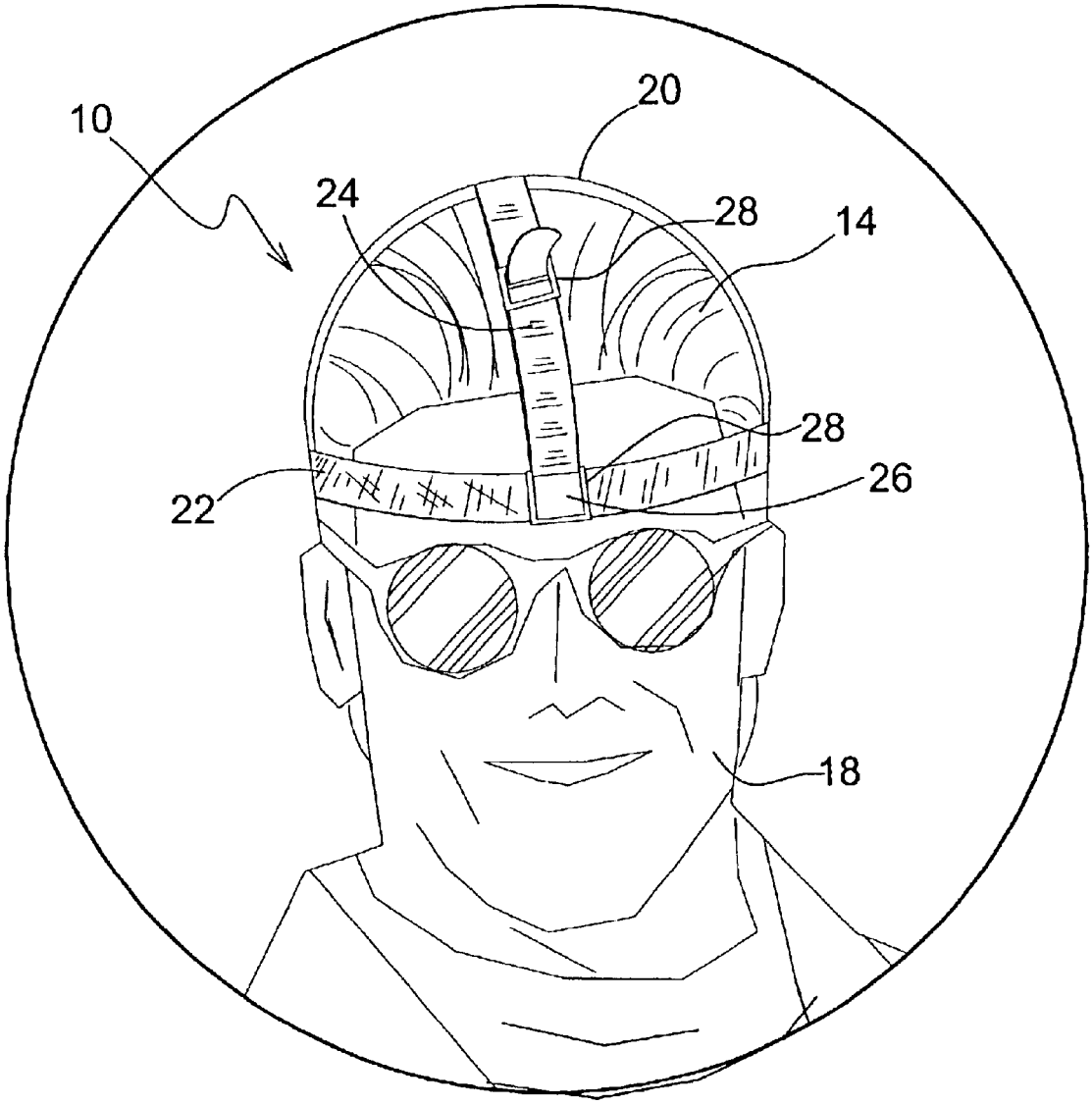
FIG. 4 is a frontal view of the present invention in use.

Turning to FIG. 4, shown therein is a frontal view of the present invention 10 in use. Shown is a front view of a user 18 wearing the protective helmet 20 of the present invention 10. As shown the helmet 20 is a low profile device designed to protect the back of the head 14 from injury due to a severe blow. The provided straps 22, 24 enable the user 18 to selectively position the helmet 20 and maintain the positioning by adjustment of the tensioning members 28. The device 10 has a relatively small footprint, therefore the device will not inhibit the user's 18 peripheral vision or obstruct their hearing or encompass the top of the head 14 which would retain heat. The device 10 is particularly unobtrusive while affording protection from severe head injury that can occur from a fall.

Figure 5:
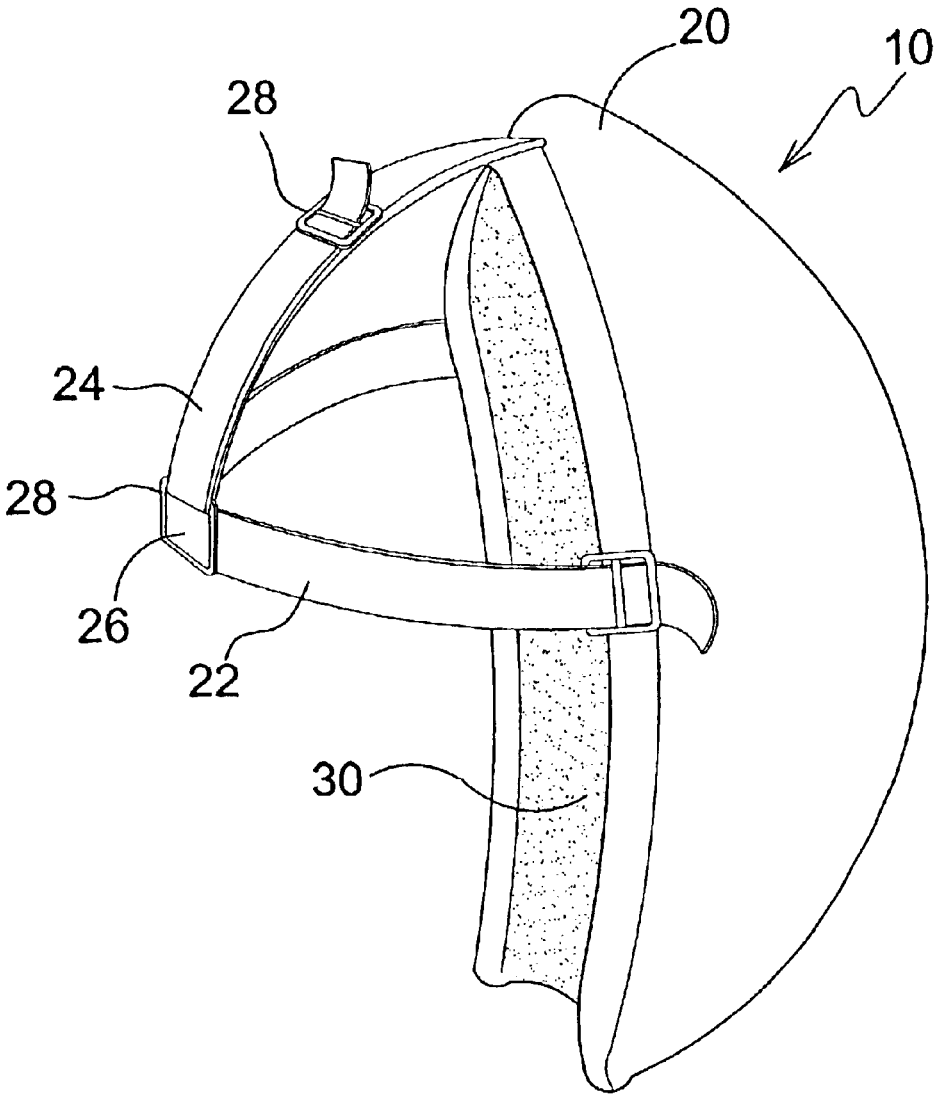
FIG. 5 is a perspective view of the present invention.

Turning to FIG. 5, shown therein is a perspective view of the present invention 10. Shown is a perspective view of the present invention 10 comprised of a convex shaped helmet 20 formed of a hard polymeric material having a cushioned interior liner 30 comprised of a foam-like material designed for the comfort of the user as well as additional protection. The helmet 20 has elastomeric adjustable headbands 22, 24 providing means for securing the helmet to the head. The helmet 20 is worn on the posterior portion of the head to protect the external occipital protuberance, occipital bone and parietal bone from a severe blow as during a backward fall. Adjustment means 28 are also shown along with a logo 26.

Figure 6:
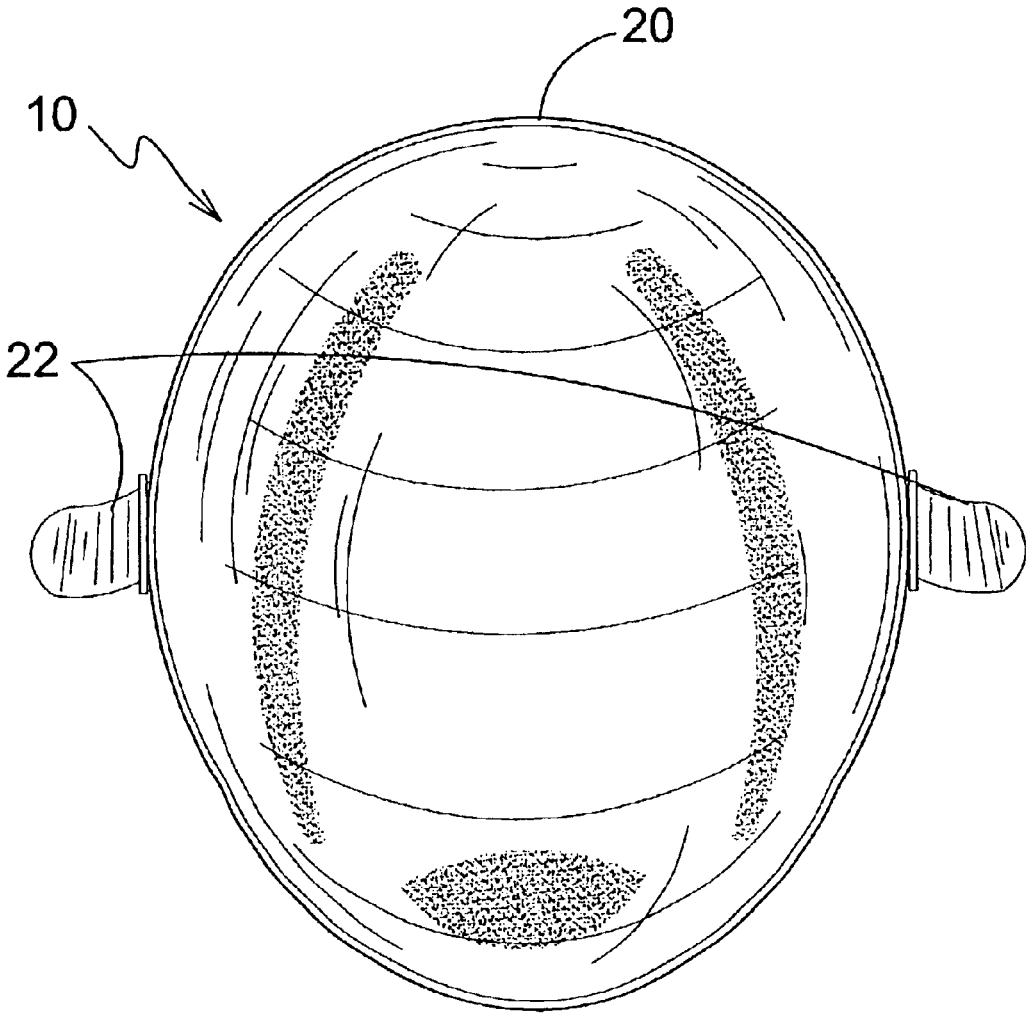
FIG. 6 is a rear view of the present invention.

Turning to FIG. 6, shown therein is a rear view of the present invention 10. Shown is a rear view of the present invention 10 showing a helmet 20 for encompassing the back of the head to protect the external occipital protuberance, occipital bone and parietal bone from a severe blow as during a backward fall. The helmet 20 is comprised of a suitable impact absorbent material to prevent the helmet from cracking. Additionally, the helmet 20 has elastomeric adjustable headbands 22 providing means for securing the helmet to the head and to prevent movement during use. The user adjusts the elastomeric straps 22 to a suitable comfort level.

Figure 7:
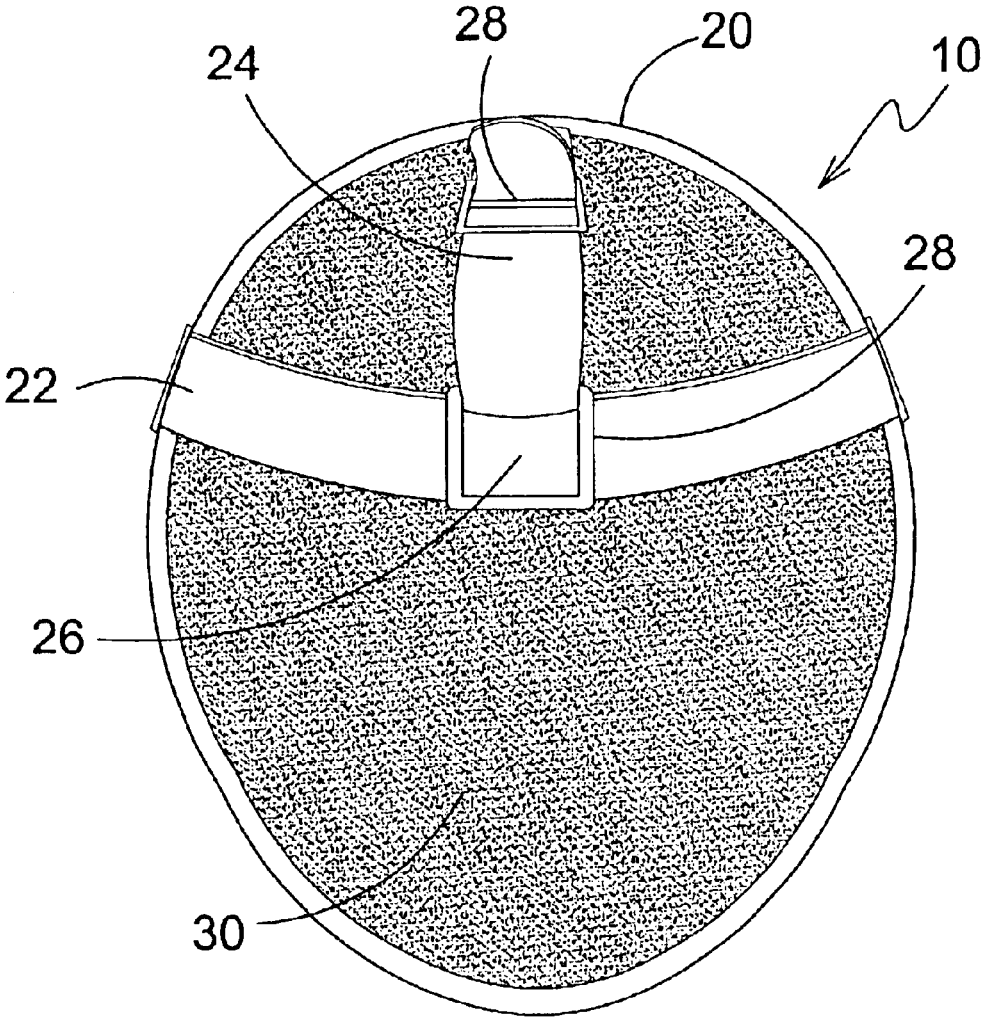
FIG. 7 is a front view of the present invention.

Tuning to FIG. 7, shown therein is a front view of the present invention 10. Shown is a front view of the present invention 10 comprised of an exterior impact absorbent material or helmet 20 and an interior foam-like material 30 that engages the external occipital protuberance, occipital bone and parietal bone and conforms substantially to the shape of the user's head. The adjustable elastomeric straps 22, 24 provide means for securing the helmet 20 to the head and to prevent movement during use. Centrally located on the straps 22, 24 convergence is an area where a logo 26 or advertisement can be placed. Adjustment means 28 are also shown along with a logo 26.

Figure 8:
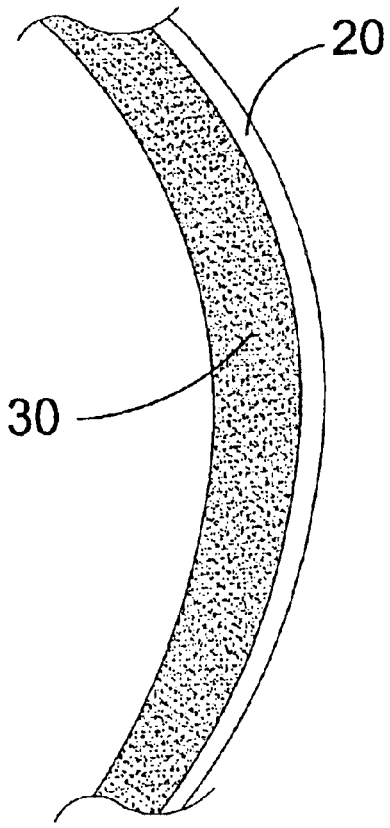
FIG. 8 is a sectional view of the present invention.

Turning to FIG. 8, shown therein is a sectional view of the present invention. Shown is a sectional view of the present invention showing the convex helmet 20 or structure of the exterior surface forming a shell that will encompass the back of the head. On the interior surface of the helmet 20 is a layer of foam-like material 30 that is bonded to the interior surface of the helmet 20 by any means well known within the art such as adhesively. The foam liner 30 affords the wearer comfort and conforms to the shape of the user's head which allows for the helmet 20 to be made in various general sizes.

I claim:

1. A helmet construction for attachment to the back of the head of a user, consisting of:

a) a helmet being convex and having an inner and outer surface, wherein said helmet is adapted to substantially cover a rear portion of the head of a user with a top edge of said helmet terminating near a midpoint on a top surface of said head of the user, said helmet having a front, a rear, a top, a bottom, and a pair of sides;

b) a liner disposed on said inner surface of said helmet whereby a cushion is provided between the helmet and the head of the user; and, c) means for attaching said helmet to the rear portion of the head of the user comprising a first strap joining opposite sides of said helmet adapted to pass over a forehead of the user and a second strap joining a midpoint of said first strap on said forehead with the top of said helmet confining said helmet to the rear portion of said head whereby the helmet protects the rear portion of the head of the user.

2. The helmet construction of Claim 1, wherein said liner comprises foam to provide a cushion between the helmet and the head of a user.

3. The helmet construction of claim 2, wherein said liner comprises compressible material to provide a cushion between the helmet and the head of a user.

4. The helmet construction of claim 3, wherein said foam is attached to said helmet by using adhesive to permit the foam to be secured to the helmet.

5. The helmet construction of claim 4, wherein said foam conforms to the shape of the head of a user to permit the foam to be contiguous to the head of the user.

6. The helmet construction of claim 5, wherein said first strap is adjustable to permit the tension of the first strap to be varied about the head of the user.

7. The helmet construction of claim 6, wherein said second strap is adjustable to permit the tension of the second strap to be varied about the head of the user.

8. The helmet construction claim 7, wherein said second strap is adjustably movable along said first strap at the point of connection of said second strap to said first strap.

9. The helmet construction of claim 8, wherein said first and second straps comprise elastomeric material.

10. The helmet construction of claim 9, where said helmet comprises a polymer material to protect the head of the user.

11. The helmet construction of claim 10, wherein said helmet comprises impact resistant material to protect the head of the user.

12. The method of protecting a rear portion of a head of user during a sporting event consisting of the steps of:

a) fitting a convex helmet over the rear portion of said head of the user with a top edge of said helmet reaching to and terminating near a midpoint a top surface of said head;

b) attaching said helmet to the head of the user by joining opposite sides of said helmet with a first strap passing across a forehead of said user and joining a midpoint of said first strap on said forehead with a top edge of said helmet using a second strap passing over said forehead and a top of said head from said first strap to said top edge of said helmet; and c) adjusting the length of each of said first and second straps to vary tension of said straps on the head of the user.

* * * * *